US006429596B1

(12) United States Patent
Jamison et al.

(10) Patent No.: US 6,429,596 B1
(45) Date of Patent: Aug. 6, 2002

(54) SEGMENTED GATE DRIVE FOR DYNAMIC BEAM SHAPE CORRECTION IN FIELD EMISSION CATHODES

(75) Inventors: Keith D. Jamison, Austin; Donald E. Patterson, Pearland, both of TX (US)

(73) Assignee: Extreme Devices, Inc., Austin, TX (US)

( * ) Notice: Subject to any disclaimer, the term of this patent is extended or adjusted under 35 U.S.C. 154(b) by 0 days.

(21) Appl. No.: 09/476,051

(22) Filed: Dec. 31, 1999

(51) Int. Cl.[7] ..... H01J 7/24

(52) U.S. Cl. ..... 315/111.81; 315/169.3; 313/306; 313/309; 313/351

(58) Field of Search ..... 315/111.81, 169.3, 315/169.4; 313/309, 302, 345, 306, 336, 351, 413, 415, 421, 461

(56) References Cited

U.S. PATENT DOCUMENTS

| | | | | |
|---|---|---|---|---|
| 3,753,022 A | | 8/1973 | Fraser, Jr. | 313/78 |
| 3,755,704 A | | 8/1973 | Spindt et al. | 313/309 |
| 3,789,471 A | | 2/1974 | Spindt et al. | 313/309 |
| 3,812,559 A | | 5/1974 | Spindt et al. | 313/309 |
| 3,970,887 A | | 7/1976 | Smith et al. | 313/309 |
| 4,178,531 A | | 12/1979 | Alig | 313/409 |
| 4,857,799 A | | 8/1989 | Spindt et al. | 313/495 |
| 5,363,021 A | | 11/1994 | MacDonald | 315/366 |
| 5,430,347 A | | 7/1995 | Kane et al. | 313/309 |
| 5,619,097 A | | 4/1997 | Jones | 313/495 |
| 5,682,078 A | | 10/1997 | Shishido | 313/336 |
| 5,719,477 A | | 2/1998 | Tomihari | 315/381 |
| 5,786,657 A | | 7/1998 | Okamoto | 313/308 |
| 5,786,669 A | | 7/1998 | Kobori et al. | 313/409 |
| 5,798,604 A | | 8/1998 | Duboc, Jr. et al. | 313/495 |
| 5,814,931 A | | 9/1998 | Makishima | 313/441 |
| 5,869,924 A | | 2/1999 | Kim | 313/446 |
| 5,898,262 A | | 4/1999 | Kim et al. | 313/446 |
| 5,905,332 A | | 5/1999 | Yun et al. | 313/414 |
| 5,942,849 A | | 8/1999 | Cade | 313/495 |
| 5,977,719 A | | 11/1999 | Makishima | 315/169.1 |
| 6,075,315 A | * | 6/2000 | Seko et al. | 313/336 |
| 6,181,055 B1 | | 1/2001 | Patterson et al. | 313/310 |
| 6,255,768 B1 | | 7/2001 | Gorski et al. | 313/414 |

FOREIGN PATENT DOCUMENTS

| | | |
|---|---|---|
| EP | 0 479 425 | 4/1992 |
| EP | 0 497 627 | 8/1992 |
| EP | 0 833 359 | 4/1998 |
| JP | 09306376 | 11/1997 |
| WO | WO94/15350 | 7/1994 |
| WO | WO99/39361 | 8/1999 |

OTHER PUBLICATIONS

K. Konuma, et al. "Field–Emitter Array Cathode–Ray Tube (FEA–CRT)" *SID 99 Digest (1999)* pp. 1150–1153.

D. E. Patterson, "Advanced CVD Diamond Microtip Devices for Extreme Applications", Mat. Res. Soc. Symp. Proc. voi. 509 (1998) pp. 65–75.

U.S. patent application Ser. No. 09/168,908, Patterson et al.

* cited by examiner

*Primary Examiner*—Don Wong
*Assistant Examiner*—Thuy Vinh Tran
(74) *Attorney, Agent, or Firm*—Baker Botts L.L.P.

(57) ABSTRACT

A field emission cathode providing for dynamic adjustment of beam shape is disclosed. Beam shape adjustment is accomplished by segmenting the gate electrode of a gated field emission cathode and independently driving the various gate segments to form the desired beam shape. Segments can be turned on and off as the beam is deflected allowing dynamic correction of aberrations in the beam. A focus lens can be placed on the gated cathode to produce a parallel electron beam. In addition, a hollow cathode can be produced to minimize space charge repulsion in a beam.

26 Claims, 5 Drawing Sheets

SEGMENTED GATE DRIVE FOR DYNAMIC BEAM SHAPE CORRECTION IN FIELD EMISSION CATHODES

BACKGROUND OF THE INVENTION

1. Field of the Invention

This invention pertains to electron guns for devices such as cathode ray tubes (CRTs). More particularly, it relates to improved field emission arrays having integral electrodes.

2. Description of Related Art

A cathode ray tube (CRT) and any other device requiring an electron beam normally contains a hot filament to cause thermionic emission from a cathode. There has long been an interest in developing cold cathodes, depending on field emission of electrons, to replace hot cathodes. For low current devices, such as scanning electron microscopes, there are a large number of patents describing field emission electron guns. There are also a large number of patents for field emission flat panel displays where the field emitter has a low duty cycle. For higher current applications, such as TV displays, prior art field emission cathodes, generally based on molybdenum and silicon, have not proven sufficiently robust for commercial applications. Tip damage occurs from ion back scattering caused by the presence of background gases and the tips fail when driven at high current densities.

It has been demonstrated that carbon-based microtip cathodes can be fabricated and used as a replacement for molybdenum- or silicon-based microtip field emission cathodes. It has also been demonstrated that the diamond can be monolithically integrated with gated electrodes in a self-aligned structure, using integrated circuit fabrication techniques ("Advanced CVD Diamond Microtip Devices for Extreme Applications," Mat. Res. Soc. Symp. Proc., Vol. 509 (1998)).

Much of the work in field emission cathode development was directed to electron sources for use in flat panel displays. U.S. Pat. No. 3,753,022 discloses a miniature directed electron beam source with several deposited layers of insulator and conductor for focusing and deflecting the electron beam. The deposited layers have a column etched through to the point field emission source. The device is fabricated by material deposition techniques. U.S. Pat. No. 4,178,531 discloses a cathode ray tube having a field emission cathode. The cathode comprises a plurality of spaced, pointed protuberances, each protuberance having its own field emission-producing electrode. Focusing electrodes are used to produce a beam. The structure produces a plurality of modulated beams that are projected as a bundle in substantially parallel paths to be focused on and scanned over the screen of a CRT. Manufacture using a photoresist or thermal resist layer is disclosed. U.S. Pat. No. 5,430,347 discloses a cold cathode field emission device having an electrostatic lens as an integral part of the device. The electrostatic lens has an aperture differing in size from the first aperture of the gate electrode. The electrostatic lens system is said to provide an electron beam cross section such that a pixel size of from approximately 2 to 25 microns may be employed. Computer model representations of the side elevation view of prior art electron emitters are shown.

U.S. Pat. No. 5,786,657 proposes a method to minimize the nonuniform influence of surrounding electric potential on an electron beam from field emitters. A hole in the emitting surface and electrodes with suitable potentials are used to minimize beam distortion. A recent paper discusses the use of field emitter electron guns in a CRT. ("Field-Emitter Array Cathode-Ray Tube," SID 99 Digest, pp. 1150–1153, 1999) The paper discusses means for decreasing beam diameters by making smaller diameter gates and other adjustments. Also, the problem of limited pixel definition at the periphery of an ellipse-shaped beam is discussed and fabrication and use of segmented or divided focus electrodes to improve beam focus is described.

Space charge, beam deflection, beam size and position, and other factors influence the shape of the beam when a beam passes through electron optics and is focused onto an object. The shape of the beam may also vary with the angle of deflection when the beam is magnetically or electrostatically deflected. Improvement in dynamic beam-shaping methods and apparatus will provide added value for field emitter arrays for use in CRTs or other devices. The dynamic beam shaping method should be widely adaptable to a variety of conditions where the final beam-shape needs improvement, such as when an electron beam is deflected by a magnetic field. The dynamic beam shaping method should allow for the continued adjustment at different deflection angles of the beam.

BRIEF SUMMARY OF THE INVENTION

Apparatus and method are provided for dynamically adjusting the emitted beam shape from a field emission cathode having a gate electrode. The cathode emitter may be carbon-based, but other emitter materials may be used. The gate electrode in an array of field emission sources is independently controlled for each emitter or group of emitters in different areas of the array. Control of voltage on the gate electrode allows emission to be turned off and on or to be adjusted in intensity from different areas. This control allows for dynamic correction of aberrations in the beam by adjusting the emission area and shape in the emitted beam from the cathode array. Control voltages may be supplied from drive circuitry that may be controlled by a microcontroller.

DESCRIPTION OF THE DRAWINGS

For a more complete understanding of the present invention and the advantages thereof, reference is now made to the following description taken in conjunction with the accompanying drawings in which like reference numbers indicate like features and wherein.

DETAILED DESCRIPTION OF THE INVENTION

Figure 1A:
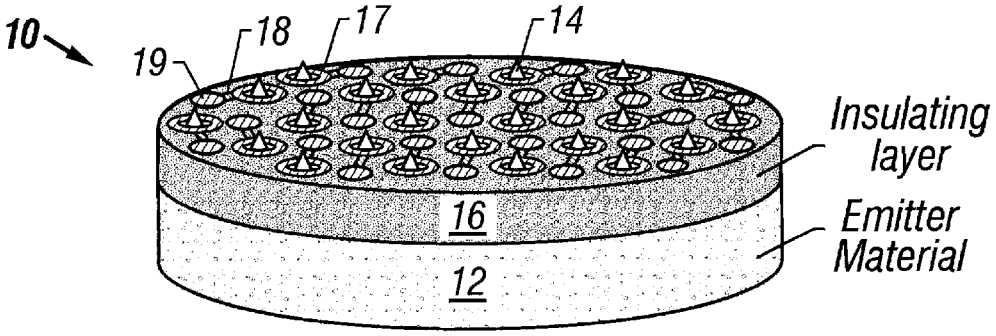
FIGS. 1A, 1B and 1C are illustrative views of an area of a field emission array having a monolithically integrated segmented gate electrode with individual control of each emitter in an array.
Figure 1B:
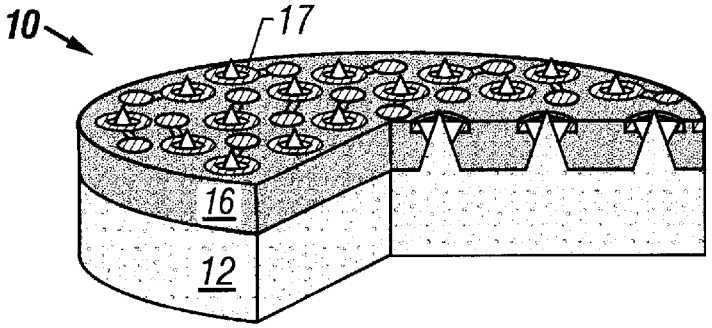

Referring to FIG. 1A, an illustration of an area of a field emitter cathode is generally shown at 10. Emitter material 12 has been used to form an array of tips 14 on the emitter material, using procedures described hereafter. In one embodiment, emitter material 12 is carbon-based material as disclosed in commonly assigned pending applications Ser. No. 09/169,908 and Ser. No. 09/169,909, filed Oct. 12, 1998 which are incorporated by reference herein. In other embodiments, emitter material 12 is tungsten, molybdenum, silicon or other materials that are commonly used for field emission sources or a wide bandgap emitter such as gallium nitride or aluminum gallium nitride. Insulating layer 16 is grown on the emitter material and then gate electrode 17 is deposited on the insulating layer. Gate holes are then defined around each emitter using etch techniques as described in the co-pending patent applications Ser. No. 09/169,908 and Ser. No. 09/169,909. Gate electrode 17 is shown in FIGS. 1A and 1B as segmented or isolated for each emission point. Via 18 connects a segmented extraction electrode to a wire pad 19. A wire (not shown) attached to a pad may supply voltage to control emission from each point. With the large number of emission points normally present in an array, this embodiment requires a large number of vias, pads, wires and control voltage sources. Any method for connecting the controlled voltage to each extraction gate may be used. Vias may extend to the edge of the array. Direct wire bonding to the gate surfaces may be used. Dynamic beam adjustment can be carried out as explained below with the greatest control over beam shape.

Figure 1C:
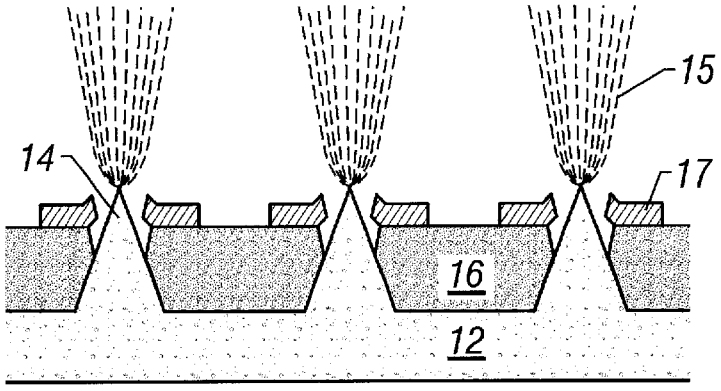

FIG. 1B shows a cut-away section of cathode 10. Gates 17 are thin layers of metal on top of dielectric layer 16. FIG. 1C illustrates a cross-section of the device showing electron beams 15 emitted from tips 14. Voltage on gate electrode 17 is selected to obtain the desired beam current. Although cathode 10 is shown as a circular design, it should be understood that the cathode may generally be square, rectangular, or any other desired shape.

Figure 2A:
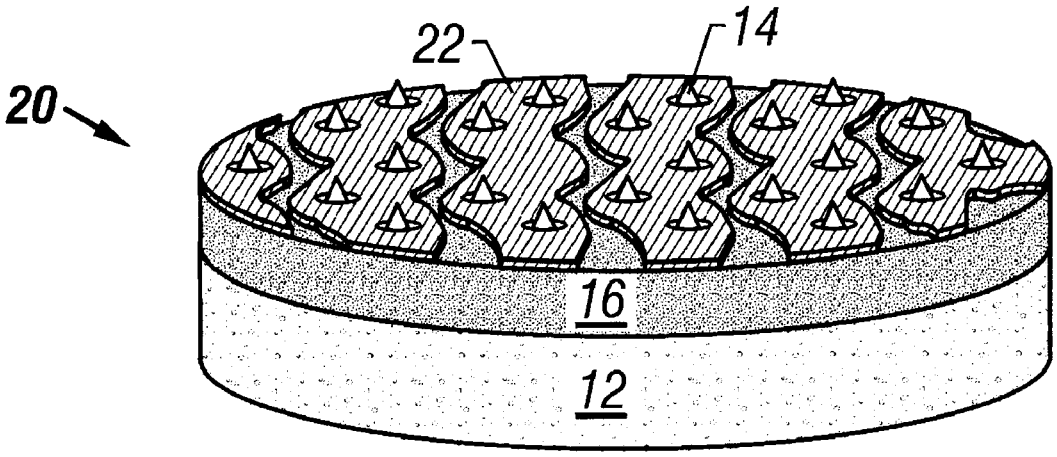
FIGS. 2A and 2B are illustrative views of an area of a field emission array having a monolithically integrated segmented gate electrode for separate control of areas of an array.
Figure 2B:
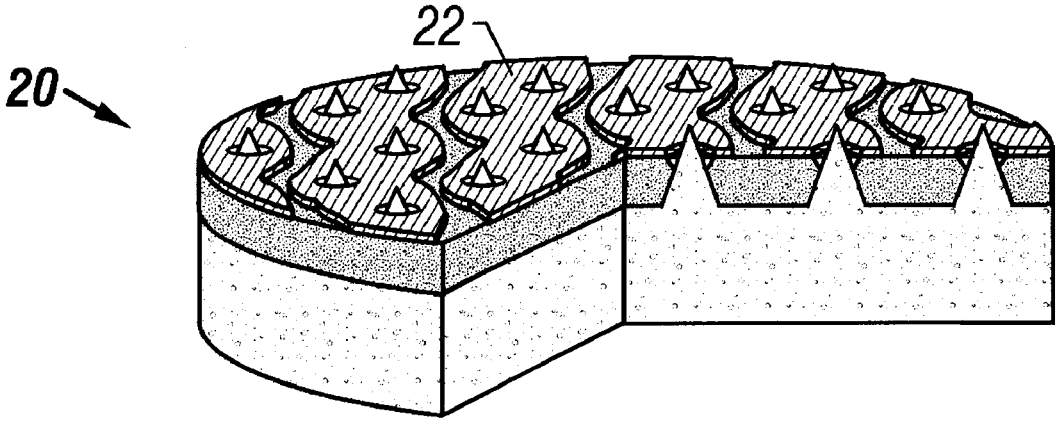

In FIG. 2A an illustration of an area of a field emitter array is generally shown at 20. Materials may be the same in the illustration of FIG. 2 as illustrated in FIG. 1, but in FIG. 2 extraction gates are ganged together in selected segments over the area of the emitter array to form voltage control areas, as shown by area 22. Voltage control areas 22 are selected to achieve the desired ability to dynamically control beam shape, as explained further below. Areas such as area 22 may be shaped to provide optimum results. The number of areas is greater than one and less than the total number of microtips. Areas may be in stripes across the array, in concentric patterns, or in any other shape. Pads may be present on such an array, as illustrated in FIG. 1, but alternatively wire bonding may be applied to areas such as area 22. FIG. 2B shows a cut-away view of an area of array 20.

Figure 3A:
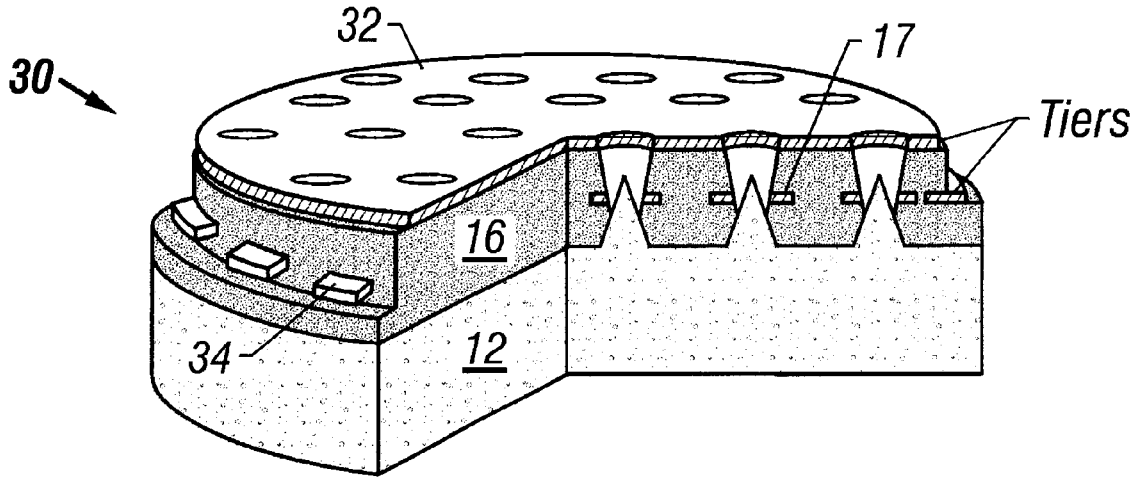
FIGS. 3A and 3B are illustrative views of a field emission array having monolithically integrated segmented gate electrode and an integrated focus electrode.
Figure 3B:
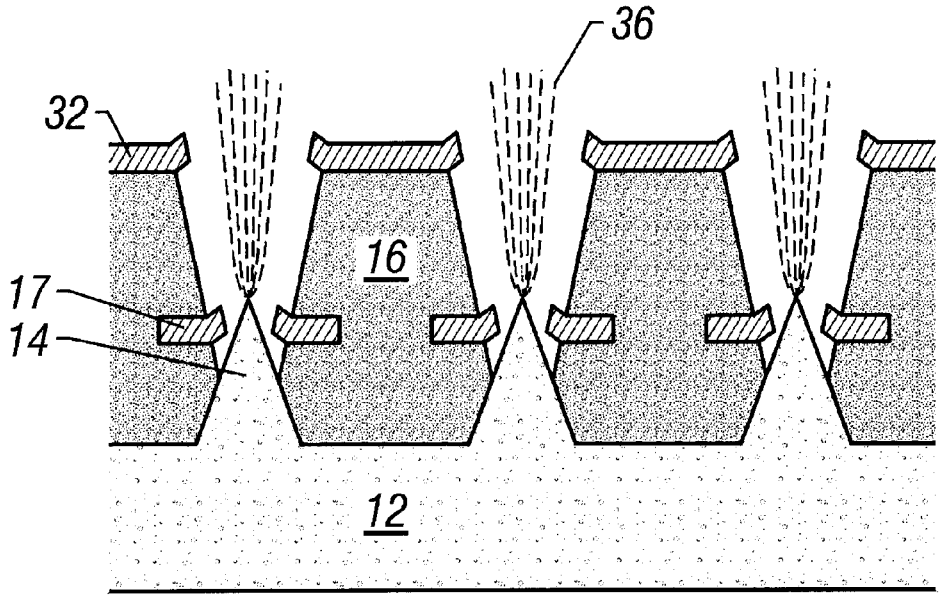

In either case (ganged or unganged gate electrodes), an additional integrated focusing lens layer may be added over the segmented gate layer. Extraction gates determine the areas of the structure that are actually on and emitting electrons; focusing lenses tend to produce a parallel beam of electrons from each emission tip. FIG. 3 illustrates an area of a segmented field emitter array generally at 30, which includes integral focus lens 32. Extraction electrode 17 is present but dielectric layer 16 now extends above electrode 17. Pads 34 have been exposed on the perimeter of an area such as to allow wire bonding to selected segments of extraction electrode 17 of FIG. 1 or areas 22 as shown in FIG. 2. Pads may be electrically connected to integral focus lens 32 and wire bonding may be applied directly to the lens segments. FIG. 3B shows a cross-section of an area of the array. The quantity of current in electron beam 36 is controlled by extraction gate 17 and each beamlet is focused by focusing electrode 32 around each point 14. Gate electrode 17 determines which tips are turned on.

Figure 4:
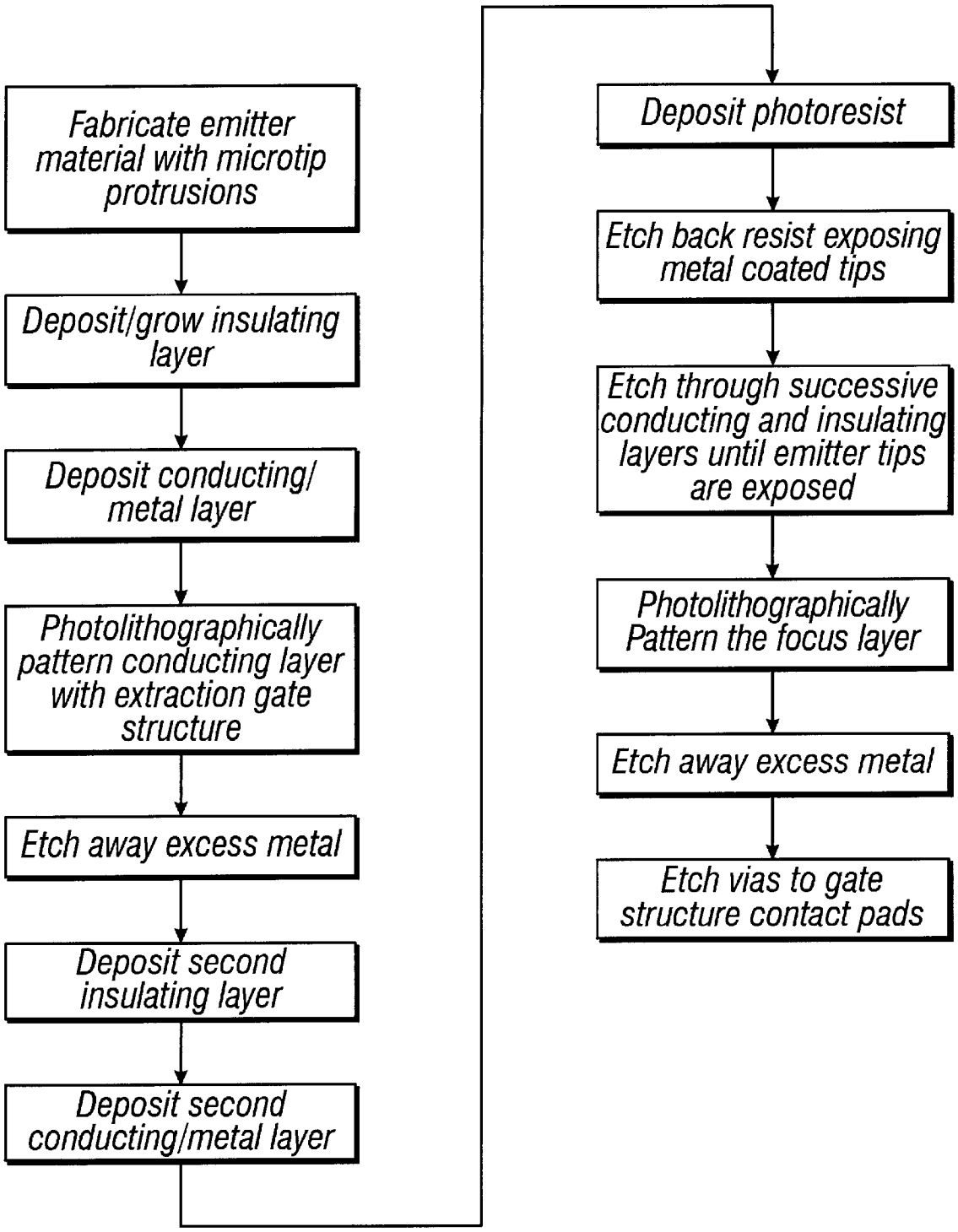
FIG. 4 shows the fabrication procedures used to form an emitter array with integrated extraction and focus electrodes with control of areas of the extraction electrode.

The fabrication processes used for producing the segmented or individual extraction gates disclosed herein include a particular combination of standard field emission array fabrication steps along with steps described in co-pending and commonly assigned applications Ser. No. 09/169,908, Ser. No. 09/169,909 and in the application titled "Compact Electron Gun and Focus Lens," Filed Jul. 19, 1999, all of which are incorporated by reference herein. FIG. 4 shows steps of the fabrication processes that may be used. An emitter array is fabricated from a suitable material such as a carbon-based material or other material disclosed herein. Normally such an array will be grown in selected parts of the surface of a wafer that is later cut into dies, each having an array of emitting tips, as is well known in the art. After tips are grown, a dielectric or insulating layer, often composed of silicon oxide, is grown or deposited over the tips. A conducting metal layer is then deposited, using known techniques. Then a photoresist layer is deposited as part of a standard photolithographical process to form a desired pattern for the extraction gate structure, vias and connecting wire pads. These steps result in structures such as shown in FIG. 1 and FIG. 2 before the hole is etched around the tip. To form the structure shown in FIG. 3, a second insulating layer is deposited over the extraction electrode, then a second metal layer that will form the focusing lenses is grown. Then a second photoresist layer is deposited, but it is not to be patterned as was the first such layer. Rather, this layer is used to form a self-aligned focus lens structure. The resist layer is spun to a thin layer and the resin of the photoresist material cured. The photoresist layer is thinner over the microtips of the array, which cause protrusions over each microtip. This feature allows a controlled dry etch to expose the second metal layer only on the tips of the protrusions. Then a series of wet and/or dry etches allows etching through successive conducting and insulating layers until emitter tips are exposed. The overall structure resembles a tip at the bottom of a well.

After the emitter tips are exposed, the focus layer is photolithographically patterned to form the final device structure. Each device is composed of one segmented array. Excess metal on the wafer between what will be different cathode devices may then be etched away. Vias to gate structure contact pads are subsequently etched to expose gate electrode contact pads such as pads 34 of FIG. 3A. Preferably, tiers are formed as shown in FIG. 3A such that dielectric layer 16 extends to the edge of emitting material 12. Emitting material is preferably in the form of a die that is cut from a wafer after arrays of field emitting points are grown on the wafer at selected locations. Similarly, to minimize short circuits, focusing electrode 32 preferably does not extend to the edge of dielectric layer 16 of FIG. 3. Although circular areas of an emitting array are shown in FIGS. 1, 2 and 3, dies are often cut into rectangular or other shapes. The field-emitting array on each die may likewise be rectangular, circular or any other desired shape.

Figure 5A:
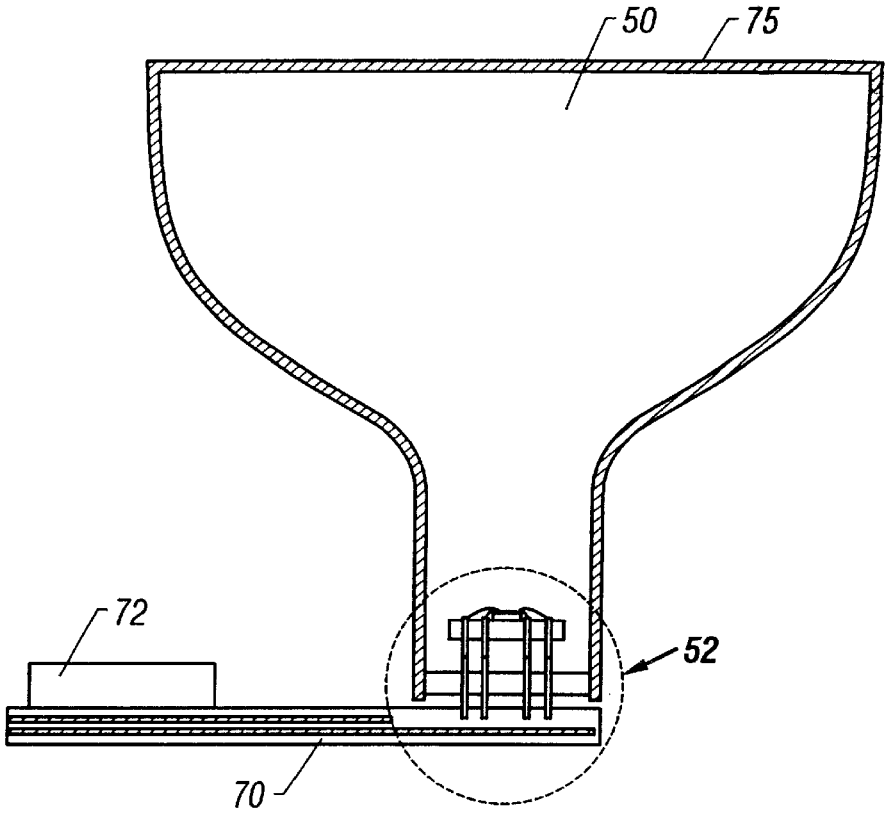
FIG. 5 illustrates the application in a CRT of an emission array with control of areas of the array by circuitry.
Figure 5B:
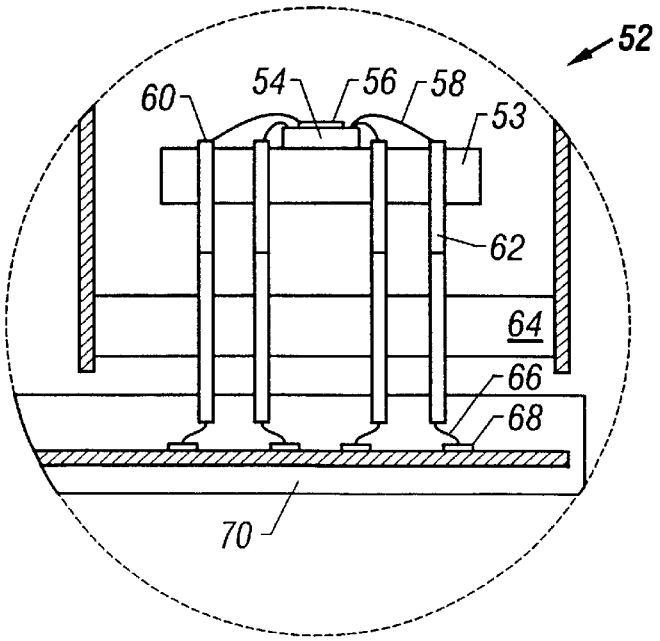

FIG. 5 illustrates the application of a segmented field-emitting array in a cathode ray tube (CRT). CRT 50 is of conventional design except for the cathode. The usual thermionic emission cathode has been replaced with a field emitting cathode structure shown generally at 52. Referring to FIG. 5B, ceramic substrate 53 supports and is electrically connected to die 54 that has segmented emitting array 56, which has been described above. Wires 58 electrically connect the cathode or the electrodes to pins 62. Wires 58 may be joined by wire bonding their ends to pads or pins 62.

Pins 62 pass outside CRT 50 through glass seal 64. Pins 62 may then be wire bonded by wire 66 to pads 68 on an electronic card or circuit 70. Drive circuitry 72 (FIG. 5A) delivers selected voltages to each pad 68 as preselected synchronous signals. The voltages control emission from each point or each selected ganged area of electron emission from array 56. By turning on or off or altering beam current from each selected segment of the array, the shape of a the total electron beam from cathode structure 52 is modified. This can be used to dynamically change the beam at different angles during magnetic deflection, for example. The voltage changes may be synchronized such that beam shape is selected for each deflection angle. This provides a beam-shaping capability not heretofore available; one that can be achieved by field emission cathodes and not by thermionic cathodes.

In one embodiment, the beam adjustments necessary to avoid distortion of the beam when the electron beam from the field emission cathode structure 52 is deflected to a selected portion of a display are determined experimentally by measuring the beam shape of a spot on the screen of the CRT at a fixed selected location. The beam is deflected to the selected portion of display screen 75 of CRT 50 and beam shape is measured on the screen. Voltage is decreased or turned off to the gate electrode for selected tips and increased at other tips while beam dimensions are measured. Optimum beam dimensions are obtained by selectively turning off or on of gate electrode voltages to selected tips or segments of tips. Preferably, when voltage is decreased at tips to decrease electron beam current from those tips, voltage is increased at other tips to maintain total beam current at approximately a constant value. Adjustments of gate electrode voltages may be controlled by a microprocessor that is programmed in accord with the measurements of beam dimensions for different areas of the display. The microprocessor turns on various segments or areas of the array depending on where the spot caused by the beam is located in the display. The microprocessor may be programmed initially to apply various patterns of voltages to different areas of an emitting array and measurements of beam area, taken either manually or by well known photosensitive instruments, may be used to select a final sequence of voltage changes during a sweep cycle of the beam.

In another embodiment, beam dimensions are calculated using known mathematical methods for electron beam simulation. Such Electron Beam Simulation (EBS) methods are discussed, for example, in the co-pending and commonly assigned application titled "Compact Field Emission Electron Gun and Focus Lens," filed Jul. 19, 1999, and incorporated by reference herein. Such calculation may be performed with selected areas of an array emitting no beam current or a selected beam current. The size and shape of the beam on a display at a selected distance may then be calculated. Deflection of the beam may also be simulated and included in the calculation of beam dimensions. In addition, a hollowbeam pattern can be produced by control of extraction electrode voltages in the center of an array to eliminate or minimize electron current from that area of an array. This beam pattern would minimize space charge repulsion in a beam.

While the foregoing disclosure and description for fabricating the segmented gate drive has concentrated mainly on a "self-aligned" fabrication process, the fabrication of segmented gate drives can easily be added as a modification to processes for fabricating other types of field emission cathode structures. U.S. Pat. Nos. 3,755,704, 3,789,471, 3,812,559, and 3,970,887, all of which are incorporated by reference herein, are representative of other prior art techniques used to fabricate field emission cathodes. Having fabricated a prior art field emission cathode, our segmented gate structure would be added by photolithographically defining the segmented structure into the existing extraction gate structure through a series of photolithography and metal etch steps. The focus electrode could then also be added to prior art cathodes in the manner disclosed herein.

The foregoing disclosure and description are illustrative and explanatory thereof, and various changes in the details of the illustrated apparatus and construction and method of operation may be made without departing from the spirit of the invention.

What is claimed is:

1. A field emitting cathode, comprising:

a die having a surface and providing an array of microtip protrusions extending outward from the surface;

a first dielectric layer contiguous with the array;

a plurality of gate electrodes extending outward from the first dielectric layer and around and spaced apart from each of the microtip protrusions to affect current in an electron beam from the microtips when variable values of electrical voltage are applied to the gate electrodes; and electrical connections to the gate electrodes.

2. The field emitting cathode of claim 1 wherein the die and the microtip protrusions are made of carbon-based material.

3. The field emitting cathode of claim 1 wherein the first dielectric layer is made of silicon oxide.

4. The field emitting cathode of claim 1 wherein the electrical connections comprise a via and a wire bonding pad.

5. The field emitting cathode of claim 1 further comprising a second dielectric layer continuous with the first dielectric layer and extending outward from the gate electrodes, a plurality of focus lenses extending outward from the second dielectric layer and around and spaced apart from each of the microtips and electrical connection to the focus lenses.

6. The field emitting cathode of claim 5 wherein the electrical connection to the focus lenses comprises a wire bonded to a layer containing the focus lenses.

7. The field emitting cathode of claim 1 further comprising a layer of electrically conducting material between selected gate electrodes to gang together the selected gate electrodes and form a voltage control area.

8. A method for adjusting shape of an electron beam impinging on a display screen of a cathode ray tube at a selected deflection angle, comprising:

providing a field emitting cathode including a die having a surface and an array of microtip protrusions extending outward from the surface, a first dielectric layer contiguous with the array, a plurality of gate electrodes extending outward from the first dielectric layer and around and spaced apart from each of the microtip protrusions to affect current in an electron beam from the microtips when variable values of electrical voltage are applied to the gate electrodes, and electrical connections to the gate electrodes;

mounting the cathode in a cathode ray tube;

operating the cathode ray tube and applying voltage to the array to cause the beam to impinge and form a spot on a display screen of the cathode ray tube at a selected deflection angle; and observing the shape of the spot and adjusting the voltage applied to one or more gate electrodes to adjust the shape of the spot.

9. The method of claim 8 wherein the array of microtips consists essentially of carbon-based material.

10. The method of claim 8 wherein the field emitting cathode further comprises a second dielectric layer continuous with the first dielectric layer and extending outward from the gate electrodes, a plurality of focus lenses extending outward from the second dielectric layer and around and spaced apart from each of the microtips and electrical connection to the focus lenses.

11. The method of claim 8 further comprising the step of calculating the shape of the electron beam using Electron Beam Simulation.

12. The method of claim 8 wherein the array further comprises a layer of electrically conducting material between selected gate electrodes to gang together the selected gate electrodes and form a voltage control area of gate electrodes and the voltage applied to one or more gate electrodes to adjust the shape of the spot is applied by applying a voltage to one or more voltage control areas.

13. A method for determining a preferred voltage pattern to be applied to a field emitter cathode having an array at a selected deflection angle of an electron beam from the array, comprising:

providing a field emitting cathode including a die having a surface and the array of microtip protrusions extending outward from the surface, a first dielectric layer contiguous with the array, a plurality of gate electrodes extending outward from the first dielectric layer and around and spaced apart from each of the microtip protrusions to affect current in an electron beam from the microtips when variable values of electrical voltage are applied to the gate electrodes, and electrical connections to the gate electrodes;

mounting the cathode in a cathode ray tube;

operating the cathode ray tube and applying variable values of electrical voltage to the gate electrodes to produce a voltage pattern on the array while the beam impinges and forms a spot on a display screen of the cathode ray tube at a selected deflection angle;

observing the shape of the spot while adjusting the voltage pattern applied to the array until a selected shape of the spot occurs; and recording the values in the voltage pattern on the array producing the selected shape of the spot at the selected deflection angle.

14. The method of claim 13 wherein the array of microtips consists essentially of carbon-based material.

15. The method of claim 13 wherein the field emitting cathode further comprises a second dielectric layer continuous with the first dielectric layer and extending outward from the gate electrodes, a plurality of focus lenses extending outward from the second dielectric layer and around and spaced apart from each of the microtips and electrical connection to the focus lenses.

16. The method of claim 13 further comprising the step of calculating the shape of the electron beam using Electron Beam Simulation.

17. The method of claim 13 wherein the array further comprises a layer of electrically conducting material between selected gate electrodes to gang together the selected gate electrodes and form a voltage control area of gate electrodes and the voltage applied to one or more gate electrodes to adjust the shape of the spot is applied by applying a voltage to one or more voltage control areas.

18. The method of claim 13 wherein the array further comprises a layer of electrically conducting material between selected gate electrodes to gang together the selected gate electrodes and form a voltage control area of gate electrodes.

19. A method for dynamically shaping an electron beam in a cathode ray tube, comprising:

providing a field emitting cathode including a die having a surface and an array of microtip protrusions extending outward from the surface, a first dielectric layer contiguous with the array, a plurality of gate electrodes extending outward from the first dielectric layer and around and spaced apart from each of the microtip protrusions to affect current in an electron beam from the microtips when variable values of electrical voltage are applied to the gate electrodes, and electrical connections to the gate electrodes;

mounting the cathode in a cathode ray tube, and operating the cathode ray tube and applying variable values of electrical voltage to the gate electrodes to produce a selected voltage pattern on the array corresponding to a deflection angle of the beam.

20. The method of claim 19 wherein the selected voltage pattern for each deflection angle of the beam is controlled by a microcontroller.

21. The method of claim 19 wherein the selected voltage pattern for each deflection angle, of the beam maintains an approximately constant beam current for each deflection angle of the beam.

22. The method of claim 19 drive circuitry applies the selected voltage pattern on the array for each deflection angle as preselected synchronous signals.

23. A cathode ray tube, comprising:

a shell having a display screen and. electrodes therein, a deflector for an electron bear and electrical connections through the shell;

a field emitting cathode including a die having a surface and providing an array of microtip protrusions extending outward from the surface, a first dielectric layer contiguous with the array, a plurality of gate electrodes extending outward from the first dielectric layer and around and spaced apart from each of the microtip protrusions to affect current in an electron beam from the microtips when variable values of electrical voltage are applied to the gate electrodes; and electrical connections to the gate electrodes.

24. The cathode ray tube of claim 23 wherein the field emitting cathode further comprises a second dielectric layer continuous with the first dielectric layer and extending outward from the gate electrodes, a plurality of focus lenses extending outward from the second dielectric layer and around and spaced apart from each of the microtips and electrical connection to the focus lenses.

25. The cathode ray tube of claim 23 wherein the array of microtips consists essentially of carbon-based material.

26. A field emitting cathode, comprising:

a semiconductor substrate, a first insulating layer formed over a surface of the semiconductor substrate, an overlying conductive layer formed over the insulating layer and at least one field emission cathode site comprised of an opening formed in the insulating layer and overlying conductive layer exposing a part of the underlying semiconductor substrate with the central region of the exposed underlying semiconductor forming a raised emitting tip of semiconductor integral with the underlying semiconductor substrate;

a second insulating layer overlying the conductive layer;

a segmented voltage control area overlying the second insulating layer;

electrical connections to the segmented voltage control area.

* * * * *